US006162150A

United States Patent [19]

Lee

[11] Patent Number: 6,162,150

[45] Date of Patent: Dec. 19, 2000

[54] FOOT MASSAGING EXERCISING APPARATUS

[76] Inventor: Joseph Chen Lung Lee, P.O. Box 82-144, Taipei, Taiwan

[21] Appl. No.: 09/059,002

[22] Filed: Apr. 13, 1998

[51] Int. Cl.[7] ..... A63B 22/08; A61H 7/00

[52] U.S. Cl. ..... 482/51; 482/80; 601/28; 601/31; 601/134

[58] Field of Search ..... 482/52, 53, 51, 482/79, 80; 601/23, 27, 28, 29, 31, 33, 134

[56] References Cited

U.S. PATENT DOCUMENTS

| | | | |
|---|---|---|---|
| 2,772,881 | 12/1956 | Fundom | 601/29 |
| 3,525,522 | 8/1970 | Piller | 482/80 |
| 3,598,404 | 8/1971 | Bowman | 482/80 |
| 5,423,729 | 6/1995 | Eschenbach | 482/70 |
| 5,433,684 | 7/1995 | Carrillo | 482/80 |
| 5,665,033 | 9/1997 | Palmer | 482/71 |
| 5,765,921 | 6/1998 | Chuang | 601/28 |
| 5,827,205 | 10/1998 | Iwamoto | 601/28 |

*Primary Examiner*—Stephen R. Crow
*Assistant Examiner*—Benjamin K. Koo
*Attorney, Agent, or Firm*—A & J

[57] ABSTRACT

A foot massaging exercising apparatus includes a base, a pair of upright rocker bars, a pair of foot pedals, and massaging boards. The base has securing seats at a front end thereof and bearing frames at a rear end thereof. The rocker bars are pivotally mounted at the securing seats such that the user may swing them forwardly or rearwardly. The foot pedals are mounted at the bearing frames and are capable of free swinging movement. Two massaging boards, one inclining forwardly, the other inclining rearwardly, are pivotally mounted in the bearing frames below each foot pedal. One side of each foot pedal extends downwardly to form a flange. The flange is connected via a link to the lower portion of the corresponding rocker bar. When the user swings the rocker bars, due to the arrangement of the links, the foot pedals may be caused to swing forwardly and rearwardly therewith in turn. The massaging boards have massaging bosses thereon which project through corresponding elongate through holes formed in the foot pedals to intermittently acupuncture points on the user's soles. Two hydraulic retractable rods are further provided to provide a suitable resistance and achieve a stable exercising state.

3 Claims, 4 Drawing Sheets

FOOT MASSAGING EXERCISING APPARATUS

BACKGROUND OF THE INVENTION

1. Field of the Invention

The present invention relates generally to a foot massaging exercising apparatus, and more particularly to an exercising apparatus in which the user swings two rocker bars to cause two foot pedals to swing back and forth via linking-up movement, massaging boards being provided beneath the foot pedals such that massaging bosses on the massaging boards may project through through holes formed in the foot pedals to intermittently massage the acupuncture points on the user's soles to stimulate blood circulation while allowing exercising of the hands and legs.

2. Description of the Prior Art

Modern people work under pressure and may suffer from sore back and high blood pressure if proper attention is not paid to health and exercising. Massaging may help alleviate the soreness and stimulate blood circulation to promote health.

It has been proven that there are many acupuncture points on the soles. Proper massaging of the acupuncture points on the soles will promote the health of the body and the functions of body organs. There are all kinds of massaging apparatuses available in the market. Some parks are also provided with pebble paths on which people may walk bare-footed so as to stimulate the acupuncture points on the soles. But pebbles are hard and may be pointed, which are painful to walk on. Excessive stimulation is harmful to health. According to Chinese medicine, strong stimulation of the soles may make a patient feel physically well at the beginning though the soles may feel painful. But after some time, while the patient will not feel any pain when strong pressure is applied to his/her soles, which have actually become callous, he/she will still suffer from the same illness. For people of weaker physique, their illness may worsen. Worse still, they may suffer from other illnesses due to excessively strong stimulation of the soles. "Pain" is a signal indicating that some body organs are malfunctioning or being damaged. In the past, people believed that stimulation of the acupuncture points on the soles, such as walking on pebbles, would promote health and cure certain illnesses. But improper stimulation of the acupuncture points may hinder the proper functions of body organs.

SUMMARY OF THE INVENTION

The present invention relates generally to a foot massaging exercising apparatus, and more particularly to an exercising apparatus in which the user swings two rocker bars to cause two foot pedals to swing back and forth via linking-up movement, massaging boards being provided beneath the foot pedals such that massaging bosses on the massaging boards may project through through holes formed in the foot pedals to intermittently massage the acupuncture points on the user's soles to stimulate blood circulation while allowing exercising of the hands and legs.

A primary object of the present invention is to provide a foot massaging exercising apparatus which does not require any electrical power supply and is manually operable to provide proper stimulation of the soles of the user.

In order to achieve the above-mentioned object, the present invention comprises a base, a pair of upright rocker bars, a pair of foot pedals, and massaging boards. The base has securing seats at a front end thereof and bearing frames at a rear end thereof. The rocker bars are pivotally mounted at the securing seats such that the user may swing them forwardly or rearwardly. The foot pedals are mounted at the bearing frames and are capable of free swinging movement. Two massaging boards, one inclining forwardly, the other inclining rearwardly, are pivotally mounted in the bearing frames below each foot pedal. One side of each foot pedal extends downwardly to form a flange. The flange is connected via a link to the lower portion of the corresponding rocker bar. When the user swings the rocker bars, due to the arrangement of the links, the foot pedals may be caused to swing forwardly and rearwardly therewith in turn. The massaging boards have soft elastic massaging bosses thereon which project through corresponding through holes formed in the foot pedals to intermitte the user's soles. Two hydraulic retractable rods are further provided to provide a suitable resistance and achieve a stable exercising state. By means of the present invention, the user may not only properly stimulate the acupuncture points on his/her soles to promote health and blood circulation but also exercise the hands and legs.

DETAILED DESCRIPTION OF THE PREFERRED EMBODIMENT

Figure 1:
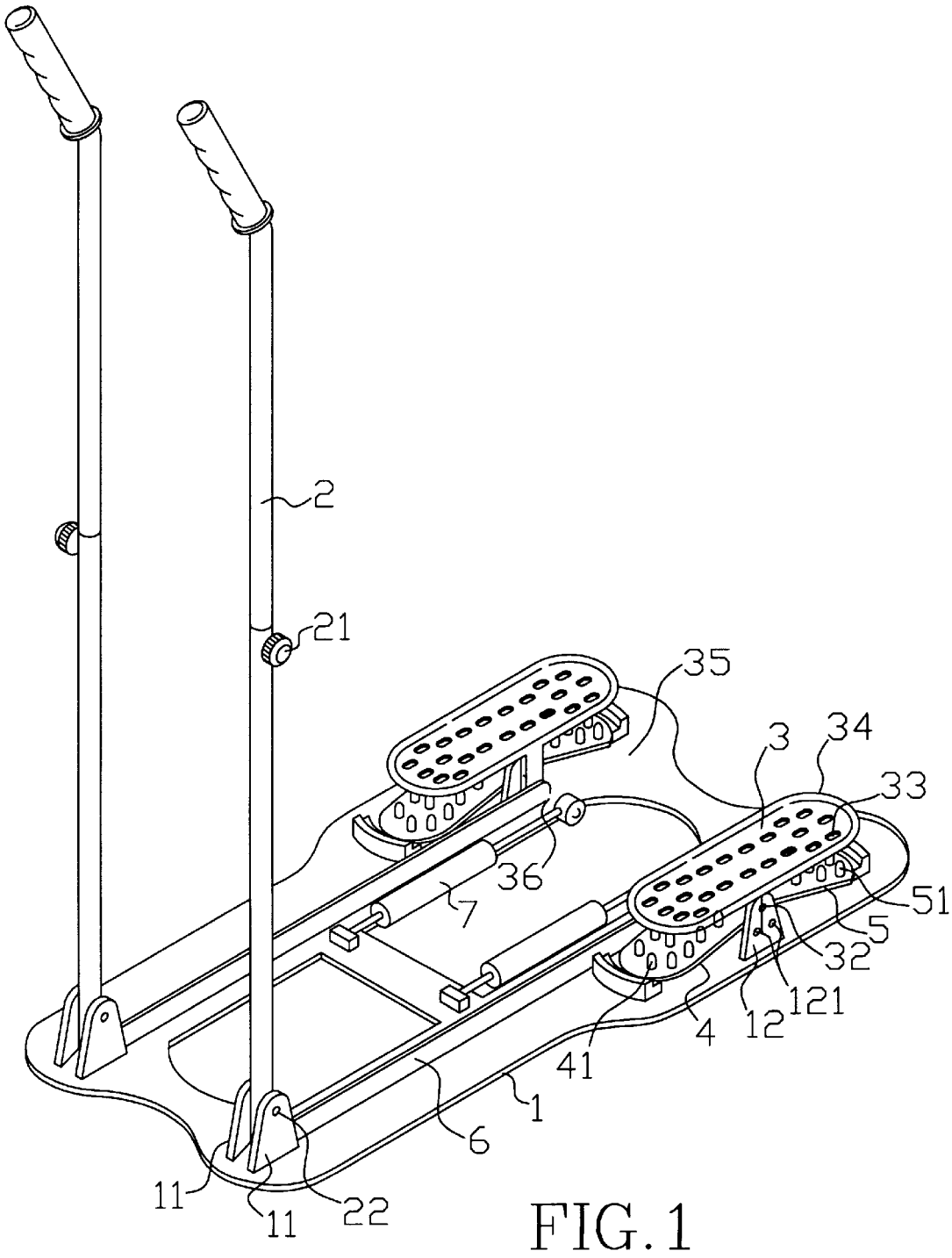
FIG. 1 is a schematic perspective view of the present invention.
Figure 2:
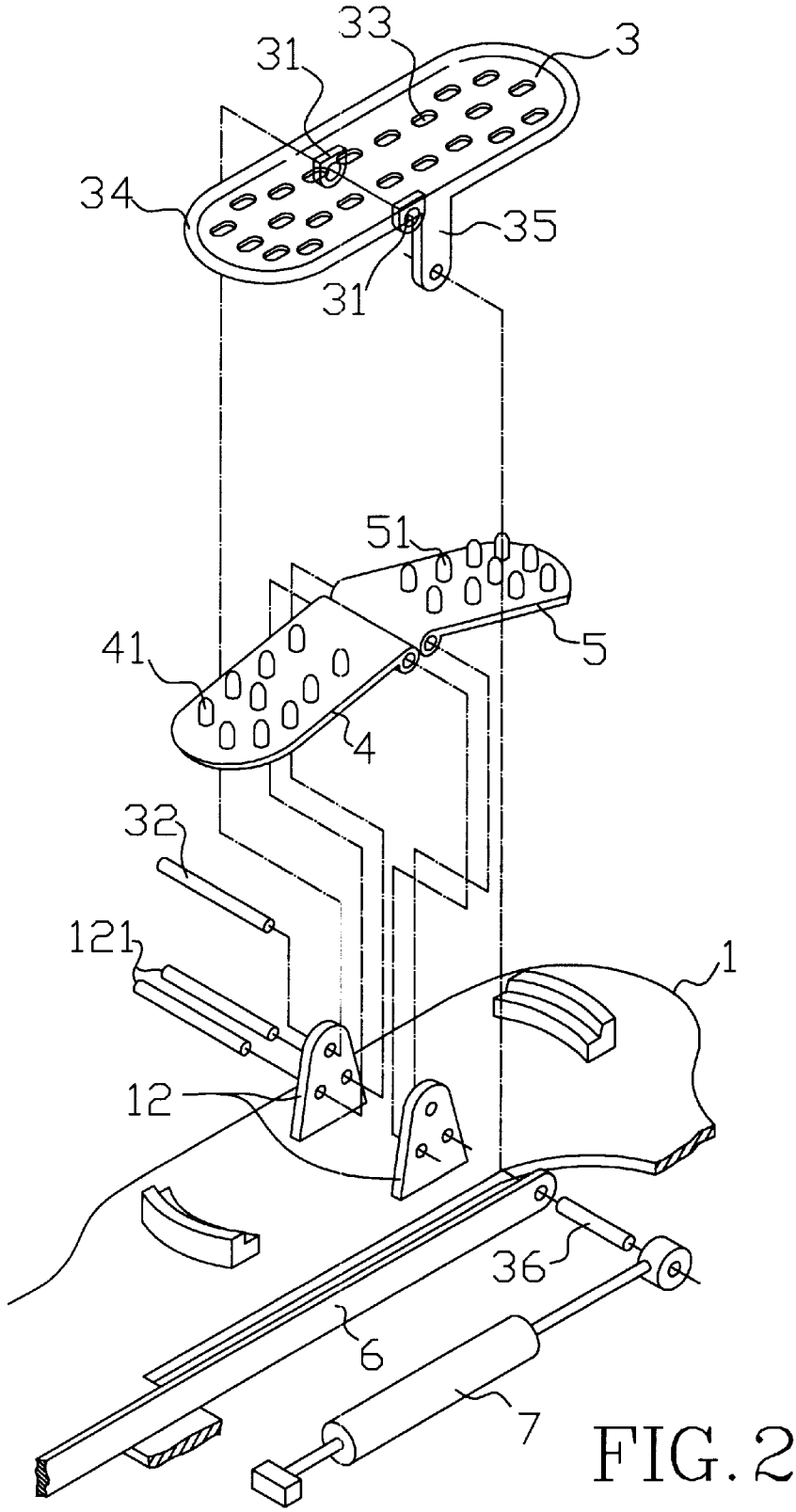
FIG. 2 is a schematic perspective exploded view of the foot pedals according to the present invention.

With reference to FIGS. 1 and 2, the present invention comprises a base 1, two rocker bars 2 provided at a front end of the base 1, and two foot pedals 3 provided at the rear end of the base 1. The base 1 includes two symmetrical securing seats 11 its front end, two pairs of mounting frames 12 at its rear end.

The rocker bars 2 are upright bars each having a lower end pivotally connected the corresponding securing seat 11. The user may grip the rocker bars 2 to swing them to the front or to the back at will. Rotary knobs 21 are provided on the rocker bars 2 to allow adjustment of the position of the rocker bars 2 to suit users of different heights.

Each foot pedal 3 is provided with two lugs 31 near the lateral edges of the bottom side at the central portion thereof. Pins 32 are used to pivotally mount the lugs 31 of the foot pedals 3 to the mounting frames 12 of the base 1. The foot pedals 3 may use the pivot points as fulcrum to freely swing back and forth. Two massaging boards 4 and 5, one slanting to the front, the other slanting to the rear, are pivotally installed below each foot pedal 3 at the inner sides of the pair of mounting frames 12 by pins 121. The massaging boards 4 and 5 have massaging bosses 41 and 51 provided thereon. Each foot pedal 3 is formed with elongated through holes 33 through which the massaging bosses 41 and 51 of the massaging boards 4 and 5 may project. The rim of each foot pedal 3 provided with a slightly raised baffle strip 34 against which the user's ankle and toes may rest. The lateral edge at the central portion of each foot pedal 3 extends downwardly to form a flange 35 of a suitable length. The flange 35 is connected via a pin 36 to an elongate link 6 which has a front end pivotally connected to the lower end of the pivoting point of the corresponding rocker bar 2. By means of this arrangement, the foot pedals 3 may synchronously swing back and forth with the rocker bars 2. Each pin 36 is further connected to a hydraulic retractable rod 7 on the base 1. When the links 6 are brought by the rocker bars 2 to swing forwardly or rearwardly, the hydraulic retractable rods 7 may also displace therewith in a parallel fashion, so that the rocker bars 2 may create a resistance to reduce the swinging speed of the foot pedals 3 and the rocker bars 2. Hence, the user would not falter as a result of the fast swinging of the rocker bars 2 ant the foot pedals 3 when standing on the foot pedals.

In use, referring to FIGS. 1 and 2, the user grips the rocker bars 2 and steps on the foot pedals 3. Since one end of each link 6 is connected to the lower end of the pivoting point 22 of each rocker bar 2 such that the link 6 may displace forwardly and rearwardly with the pivoting point 22 as fulcrum, when the user works the rocker bars 2 with both hands, the foot pedals 2 may swing back and forth, whereby the user does not have to exert force on the massaging boards 4, the massaging bosses 41 and 51 on the massaging boards 4 and 5 will project through the through holes 33 formed in the foot pedals 3 in sequence to intermittently and massage the acupuncture points on the soles of the user, thereby avoiding undesirable harm to the user's health due to excessive massaging or stimulation of the soles. Besides, when the feet swing back and forth on the foot pedals, the joints of the legs are also exercised to stimulate blood circulation. Furthermore, in the present invention, the foot pedals are provided with baffle strips 34 to prevent possible slippage of the feet from the foot pedals, and the hydraulic retractable rods 7 provide a suitable resistance to achieve stable and balanced exercising effects.

Figure 3:
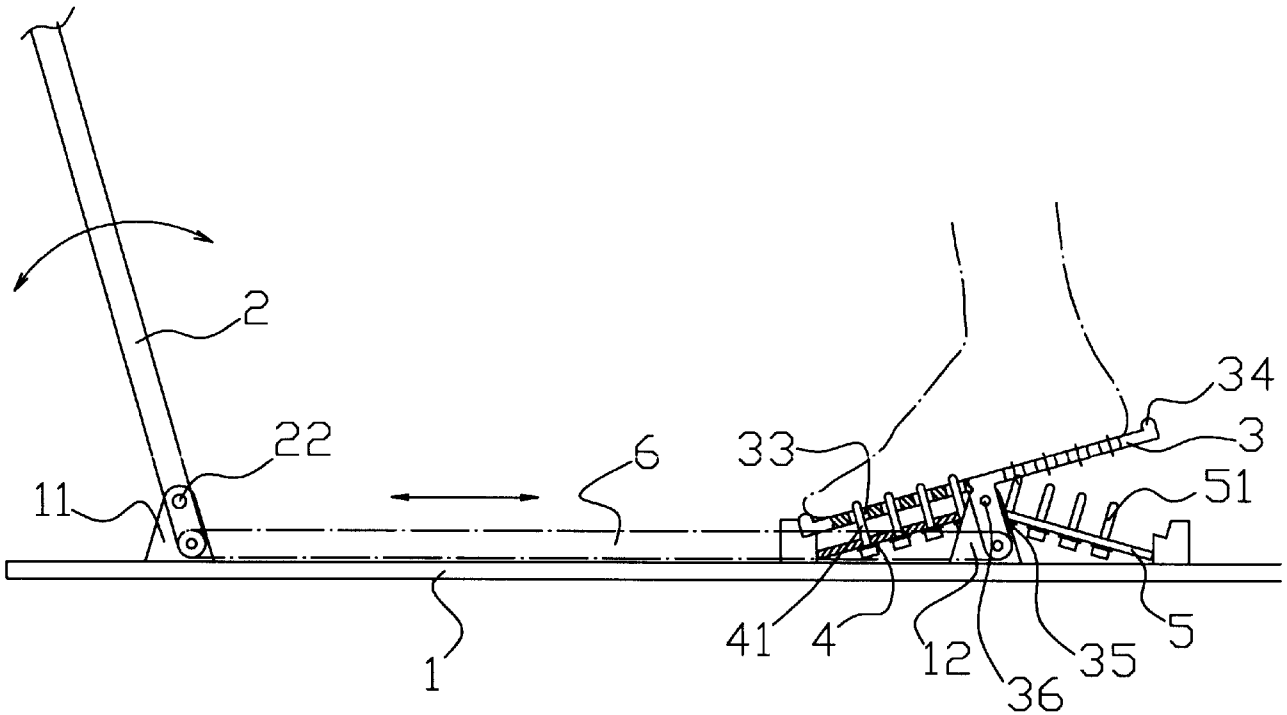
FIG. 3 is a schematic view illustrating operation of a preferred embodiment of the present invention.
Figure 3A:
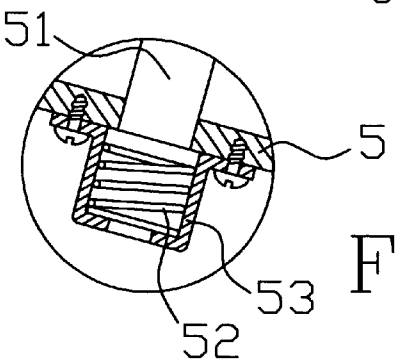
FIG. 3A is an enlarged view illustrating a massaging boss and its elastic element according to the present invention.
Figure 4:
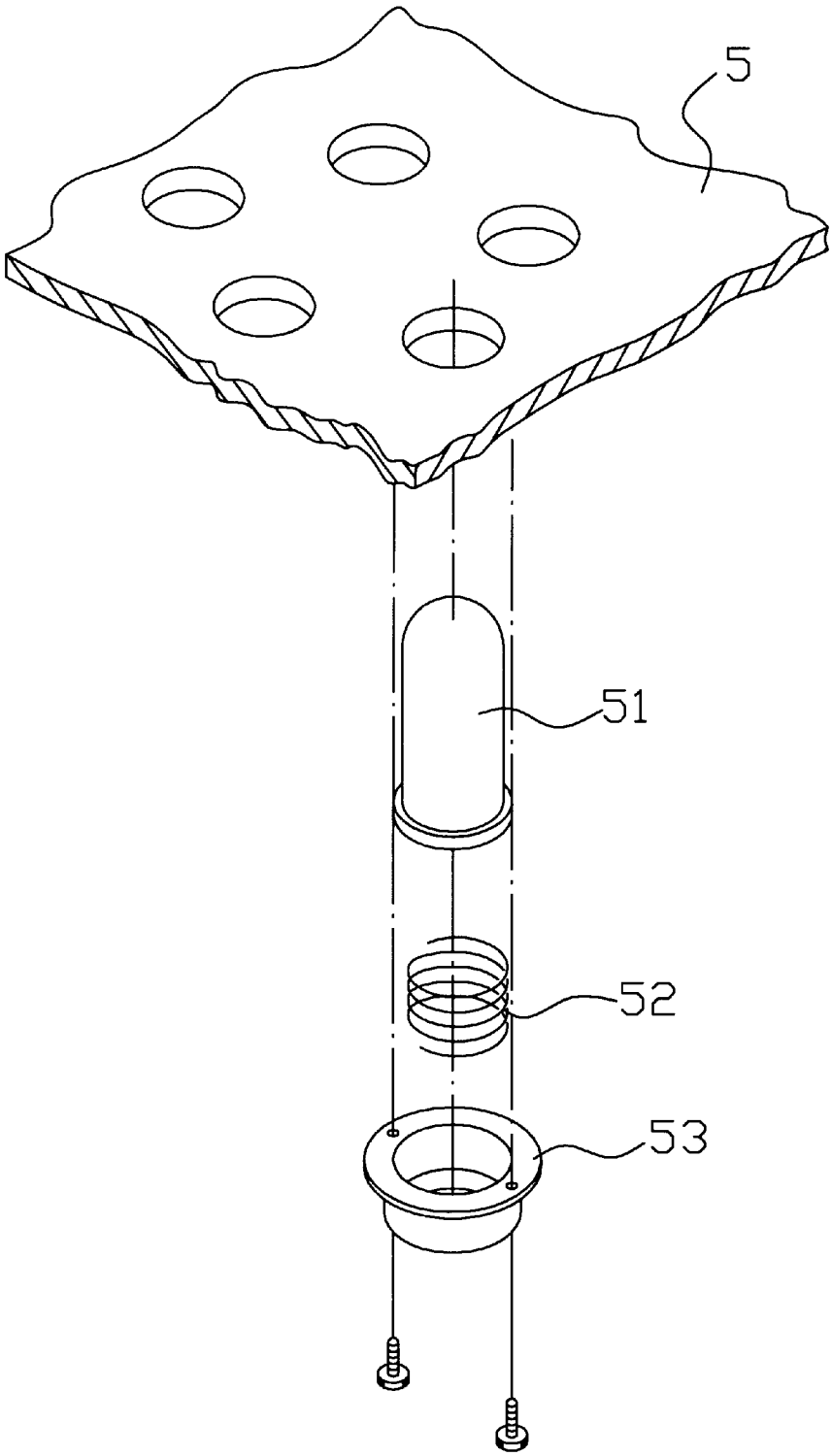
FIG. 4 is a schematic perspective exploded view illustrating the massaging boss according to the present invention.

Referring to FIGS. 3 and 4, in order to prevent excessive stimulation of the acupuncture points on the soles during massaging, the massaging bosses 41 and 51 are designed to have elasticity. The structure of the massaging bosses is hereinafter explained using massaging boss 51 as an example. The massaging boss 51 is movably provided on the massaging board 5. A sleeve element 53 accommodating therein an elastic element 52 is screwably secured below the massaging boss 51 and the massaging board 5, with the elastic element 52 urging against the massaging boss 51 so that the massaging boss 51 has suitable elasticity.

In summary, the present invention allows the user to exercise the hands and the legs and provides intermittent and suitable massaging action on the soles, thus eliminating the drawbacks with conventional foot massaging apparatus, which has the disadvantage of excessively stimulating the soles.

The invention is naturally not limited in any sense to the particular features specified in the foregoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A foot massaging exercising apparatus, comprising a base, a pair of upright rocker bars disposed at a front end of said base, a pair of foot pedals disposed at a rear end of said base, said rocker bars each being provided with a rotary knob at a suitable position to allow adjustment of the height of said rocker bars and being pivotally connected to a securing seat of said base, wherein each of said foot pedals has two lugs extending from the lateral edges of a bottom side thereof at the center, pins being passed through holes of said lugs of said foot pedal to pivotally mount said foot pedal to a corresponding pair bearing frames of said base, two massaging boards, one inclining forwardly, the other inclining rearwardly, being pivotally mounted at the inner sides of said bearing frames below said foot pedal, said massaging boards having a plurality of soft massaging bosses provided thereon, said foot pedals being provided with elongate through holes through which said massaging bosses may project, each of said foot pedals further having a flange extending downwardly from a lateral edge at the center, said flange being connected via a pin to an elongate link, said link having a front end pivotally connected to below a pivoting point of the corresponding rocker bar, said pin connecting said link being further connected to a hydraulic retractable rod provided on said base, whereby when a user grips said rocker bars and swing them forwardly and rearwardly, said foot pedals are caused to swing back and forth via said link, and said massaging bosses on said massaging boards project from said through holes of said foot pedals to intermittently massage the soles of the user, while said hydraulic retractable rod providing a suitable resistance to reduce the speed of the swinging movement so as to achieve a stable and buffering effect.

2. The foot massaging exercising apparatus as claimed in claim 1, wherein the rim of each of said foot pedals is provided with a raised baffle strip against which the user's ankle and toes may rest so as to avoid slippage.

3. The foot massaging exercising apparatus as claimed in claim 1, wherein said massaging bosses each have a sleeve element lockably secured below, said sleeve element accommodating therein an elastic element to provide said massaging boss with a suitable elasticity.

* * * * *